US006712742B2

(12) United States Patent
Suiter

(10) Patent No.: US 6,712,742 B2
(45) Date of Patent: Mar. 30, 2004

(54) COMPACT ABDOMINAL EXERCISE APPARATUS

(76) Inventor: William G. Suiter, 1157 Emerson Ave., Campbell, CA (US) 95008

( * ) Notice: Subject to any disclaimer, the term of this patent is extended or adjusted under 35 U.S.C. 154(b) by 39 days.

(21) Appl. No.: 10/341,622

(22) Filed: Jan. 14, 2003

(65) Prior Publication Data

US 2003/0181297 A1 Sep. 25, 2003

Related U.S. Application Data

(60) Provisional application No. 60/366,121, filed on Mar. 21, 2002.

(51) Int. Cl.[7] ..... A63B 26/00; A63B 71/00

(52) U.S. Cl. ..... 482/140; 482/62; 482/148

(58) Field of Search ..... 482/140, 62, 907, 482/908, 148

(56) References Cited

U.S. PATENT DOCUMENTS 4,863,162 A * 9/1989 Neckamm et al. ..... 272/137
5,046,726 A * 9/1991 Van Straaten ..... 272/144
5,071,119 A * 12/1991 Johnson ..... 272/130

* cited by examiner

*Primary Examiner*—Nicholas D. Lucchesi
*Assistant Examiner*—L Amerson
(74) *Attorney, Agent, or Firm*—Patton Boggs LLP

(57) ABSTRACT

A compact portable abdominal exercise apparatus comprising a first member that concentrically slides in a second member, and resistance is provided by elastic attached between the distal end of the first member and the distal end of the second member. Handles position the user in an ergonomically neutral position that requires a user to crunch straight downward for the first member to slide properly within the second member. The straight downward crunching motion requires flexion of the user's lower vertebra column, thereby isolating the abdominal muscles from the hip flexors and back muscles. Molded covers protect the user from moving parts associated with the connector assembly. The elastic members can be quickly changed by the user.

19 Claims, 16 Drawing Sheets

COMPACT ABDOMINAL EXERCISE APPARATUS

CROSS-REFERENCE TO RELATED APPLICATIONS

This application claims priority from U.S. Provisional Application Ser. No. 60/366,121 filed Mar. 21, 2002. The entirety of this provisional application is incorporated herein by reference.

BACKGROUND OF THE INVENTION

1. Field of the Invention

The invention in general relates to exercise apparatuses that enable users to exercise and strengthen certain muscle groups, and more particularly to enable users to exercise and strengthen the abdominal muscles. The invention relates to a compact abdominal exercise apparatus that provides quick-change resistance and allows the user to perform abdominal crunches either in the seated or supine position.

2. Statement of the Problem

Compact abdominal exercise apparatuses that include resistive force have been known for forty years. These apparatuses typically include a resistive member that is located between a handle member and a support member. Typically, a user is in a seated position when operating these apparatuses. In this position, the support member of these apparatuses is typically placed on top of or below a user's thigh and the handle member is grasped by a user's hands. A user exerts force downward on the handle member causing compression of the resistive member and thereby exercising their abdominal muscles in the process. Further, the handle members position the user's hands in a non-ergonomical position, such as horizontal.

All known prior art compact abdominal exercise apparatuses placed the hand positions at a height that didn't enable effective ergonomic crunches by the user. These apparatuses typically place the hands of the user in an elevated position approximately equal to chin or head height. In this context, "crunch" refers to the motion in which the trunk of the human body is raised from a supine position, while the spine is flexed so that the anterior portion of the spine is convex, with the legs remaining straight or bent. A crunch motion needs to be straight downward, thereby isolating abdominal muscles from hip flexors and back muscles. Otherwise, the hip flexors and back muscles are contributing to the exertive force and the abdominal muscle groups are not isolated and exercised independently. The range of travel for many of the prior art compact abdominal exercising apparatuses is generally too much to be conducive to a short crunch of the abdominal muscles.

These apparatuses typically include a resistive member that is some variation of a springing mechanism. When these springing mechanisms are located on the outside of a sliding assembly, the user is in constant jeopardy of being pinched by the springing mechanism during exercising. Further, if the springing mechanisms are located inside of a sliding assembly, the user is unable to easily access the springing mechanisms, should they wish to adjust the springing mechanism resistive force.

These apparatuses generally are difficult to adjust the resistive forces easily. Some of these apparatuses posses no variable resistive force whatsoever, thereby being of limited use to a user. Other apparatuses have a single spring or a plurality of springs that are an integral part of the sliding assembly and that are not designed to be easily adjusted or changed. These apparatuses don't allow the user to increase or decrease the resistive force.

Some prior art apparatuses include adjustable resistive forces. These prior art apparatuses must be taken apart to access and change the resistive force. Other prior art apparatuses contain a chamber and a piston that comprise a closed system. These apparatuses' resistive forces are adjusted by increasing or decreasing the pressure within the chamber prior to exercising.

Some apparatuses include a chamber for a gas and a piston that is connected to a handle with a lower support. In these apparatuses, a vent allows the gas to escape when the piston is forced through the chamber, thereby creating resistive force, but only in one direction. Once the compression stroke is completed, a user must reposition the piston within the chamber to refill the chamber with the gas.

Therefore, to minimize the risk of injury as well as achieve a greater level of comfort and control compared to that resulting from performing abdominal exercises while lying on the floor, there has been a need for an apparatus and/or technique whereby a person sitting in a chair or lying horizontal on the ground or floor can use the crunch motion while performing repetitions of exercises equivalent to sit-ups, rotary sit-ups and/or knee-ups, but while remaining within safe limits of stress to the back and to the abdominal muscles.

U.S. Pat. No. 5,046,726 issued Sep. 10, 1991 to Willem J. Van Straaten discloses an apparatus in which a person sitting on a chair, standing, or lying on the back with knees bent, applies a pumping action to a plunger, compressing a spring in a cylinder positioned vertically between the thighs or pressed against the abdomen.

U.S. Pat. No. 5,071,119 issued Dec. 10, 1991 to Martin W. Johnson discloses an apparatus in which a person sitting on a chair with the chin at the height of a horizontal pushbar attached to a vertical column pivotally supported on the floor places the arms over the pushbar and pushes down against the resistive force of a spring in the column, while twisting the upper portion of the body to the right and left, and then slowly allows the spring's resistive force to push his trunk upward to resume the original upright position.

U.S. Pat. No. 4,863,162 issued Sep. 5, 1989 to Neckamm et al. discloses a spring-loaded piston and cylinder assembly apparatus in which a transverse handle bar attached to a rod is pushed through the spring-loaded pipe. The pipe is attached at its lower end to a transverse support rod resting on the thighs of the user, the rod being slideably disposed within the pipe.

At the same time, the prior art designs did not consider the fact that users can more quickly and efficiently exercise their muscle groups by utilizing an increasing/decreasing quick change resistive force. Prior art abdominal exercise apparatuses are generally not capable of providing a resistive force that enable a user to quickly increase or decrease the resistive force on the exercise apparatus. Further, prior art designs had unwieldy handles that didn't allow the muscle groups to be comfortably and effectively grasped, thereby allowing a user to comfortably use the exercise apparatus. Thus, it is evident that if the advantageous properties inherent in compact abdominal exercise apparatuses are to be enjoyed by the public, a significant advance in such compact abdominal exercise apparatuses is required.

SOLUTION

The present invention advances the art and helps to overcome the aforementioned problems by providing a novel adjustable resistance mechanism that includes a connector assembly and a plurality of quick change elastic members. The compact abdominal exercise apparatus according to the invention provides a connector assembly comprising a first member and a second member that slide together and define a first line of motion. The compact abdominal exercise apparatus according to the invention includes a protective cover that fits over the connector assembly to keep the internal parts, including the connector assembly, from pinching the user during use. The compact abdominal exercise apparatus according to the invention provides an ergonomical apparatus that allows a user to exercise their abdominal muscles in either a sitting position or a supine position. Each of the above features is separately novel, and the novel combination of all the features results in a compact abdominal exercise apparatus that should be a welcome addition to a user's exercise equipment stable.

The invention provides a compact abdominal exercise apparatus comprising: a lower body member adapted to engage a portion of the human body below the abdomen; an upper body member adapted to engage a portion of the human body above the abdomen; and an upper body member and lower body member connector assembly comprising: a first tube having a first tube proximal end and a first tube distal end; a second tube having a second tube proximal end and a second tube distal end, the second tube having a longitudinal slot; a first elastic anchor member attached to the first tube; a second elastic anchor member attached to the second tube; the lower body member attached to the proximal end of one of the first tube and the second tube and the upper body member attached to the proximal end of the other of the first tube and the second tube; and the first tube slideably fitting within the second tube with the first elastic anchor member extending through and longitudinally slideable within the slot and located farther from the one of the lower body support member and the upper body support member to which it is attached than the one of the lower body support member and the upper body support member to which it is not attached.

Preferably, the compact abdominal exercise apparatus further includes a first elastic member connected between the first elastic anchor member and the second elastic anchor member. Preferably, the first elastic member comprises an elastic cord. Preferably, the first elastic member comprises an elastic band. Preferably, the compact abdominal exercise apparatus further includes a second elastic member connectable between the first elastic anchor member and the second elastic anchor member. Preferably, the elastic support members comprise elastic cords. Preferably, the compact abdominal exercise apparatus further includes a protective cover substantially enclosing the connector assembly. Preferably, the compact abdominal exercise apparatus further includes an elastic member connectable between the first elastic anchor member and the second elastic anchor member, and wherein said protective cover includes an opening providing access to the elastic member. Preferably, the protective cover assembly is padded. Preferably, the lower body member is adapted to engage the front portion of the human thigh. Preferably, the upper body support member is adapted to engage a human hand.

In another aspect, the invention provides a compact abdominal exercise apparatus comprising: a forward thigh member adapted to engage the forward portion of the human thigh; an upper body member adapted to engage a portion of the body above the abdomen; a plurality of resilient cords; a lower body cord anchor; an upper body cord anchor; a constraint assembly connecting the lower body member and the upper body member; the constraint assembly permitting relative motion of the lower body member and the upper body member in a first direction along a line connecting the lower body member and upper body member and preventing relative motion of the lower body member and upper body member in directions perpendicular to the first direction; the constraint assembly including: a lower body support member rigidly connecting the lower body member and the lower body cord anchor; and an upper body support member rigidly connecting the upper body member and the upper body cord anchor; the lower body cord anchor located closer to the upper body member than the upper body cord anchor; and the resilient cords connectable between the lower body cord anchor and the upper body cord anchor. Preferably, the compact abdominal exercise apparatus further includes a protective cover substantially enclosing the constraint assembly and the cord anchors, the protective cover including an opening for accessing the cords.

In a further aspect, the invention provides a compact abdominal exercise apparatus comprising: a lower body member adapted to engage a portion of the human body below the abdomen; an upper body member adapted to engage a portion of the human body above the abdomen; a constraint assembly connecting the lower body member and the upper body member, the constraint assembly permitting relative motion of the lower body member and the upper body member in a first direction along a line connecting the lower body member and upper body member and preventing relative motion of the lower body member and upper body member in directions perpendicular to the first direction, the constraint assembly including a resistance mechanism resisting but not preventing relative motion of the lower body member and the upper body member in the first direction; and a protective cover substantially enclosing the constraint assembly. Preferably, the constraint assembly includes a resistance adjuster and the cover includes an opening providing access to the resistance adjuster. Preferably, the cover comprises a first piece and a second piece and a fastener for fastening the first piece to said second piece. Preferably, the cover comprises molded plastic.

The abdominal exercise apparatus according to the invention provides, for the first time, a compact abdominal exercise apparatus that achieves a quick change resistive force mechanism with a range of travel that is ideal for exercising the abdominal muscles. The plurality of elastic members adds efficiency to quickly increasing and decreasing the resistive forces of the invention. The molded cover adds comfort and security from the novel slotted connector assembly. Numerous other features, objects and advantages of the invention will become apparent from the following description when read in conjunction with the accompanying drawings.

DETAILED DESCRIPTION OF THE PREFERRED EMBODIMENT

Overview

The compact abdominal exercise apparatus 100 provides a convenient, comfortable, and effective approach to exercising the abdominal muscles of a user. The compact abdominal exercise apparatus 100 includes a lower body support 102 that is placed on top of a user's thighs and an upper body support 104 including handles 108 that are grasped ergonomically by a user's hands. The hands exert downward force on an upper member causing compression of the compact abdominal exercise apparatus 100 and thereby exercising the abdominal muscles.

The rectus abdominus muscles are a pair of long flat muscles, one on either side of the navel, which extend along the whole length of the front of the abdomen from the lower rib cage to the front of the iliac and pubic bones of the pelvis. The rectus abdominus muscles are interconnected by the linea alba, a band of fibrous connective tissue.

The obliquus externus abdominus muscles (external obliques) are broad, thin, flat muscles situated on the lateral and anterior parts of the abdomen and attached by fibrous connective tissue to the rectus abdominus. They extend from the medial margins of the lower rib cage and are directed outwardly toward the rim of the iliac bone of the pelvis.

The obliquus internus abdominus muscles (internal obliques) are thinner and smaller than the obliquus externus muscles. The internal obliques lie beneath and transversely to the external obliques. The internal obliques extend from the lateral margins of the lower rib cage and are directed inwardly toward the rim of the pelvic iliac bone. The internal obliques are also attached to the rectus abdominus muscles by fibrous connective tissue.

A Compact Abdominal Exercise Apparatus

Figure 1:
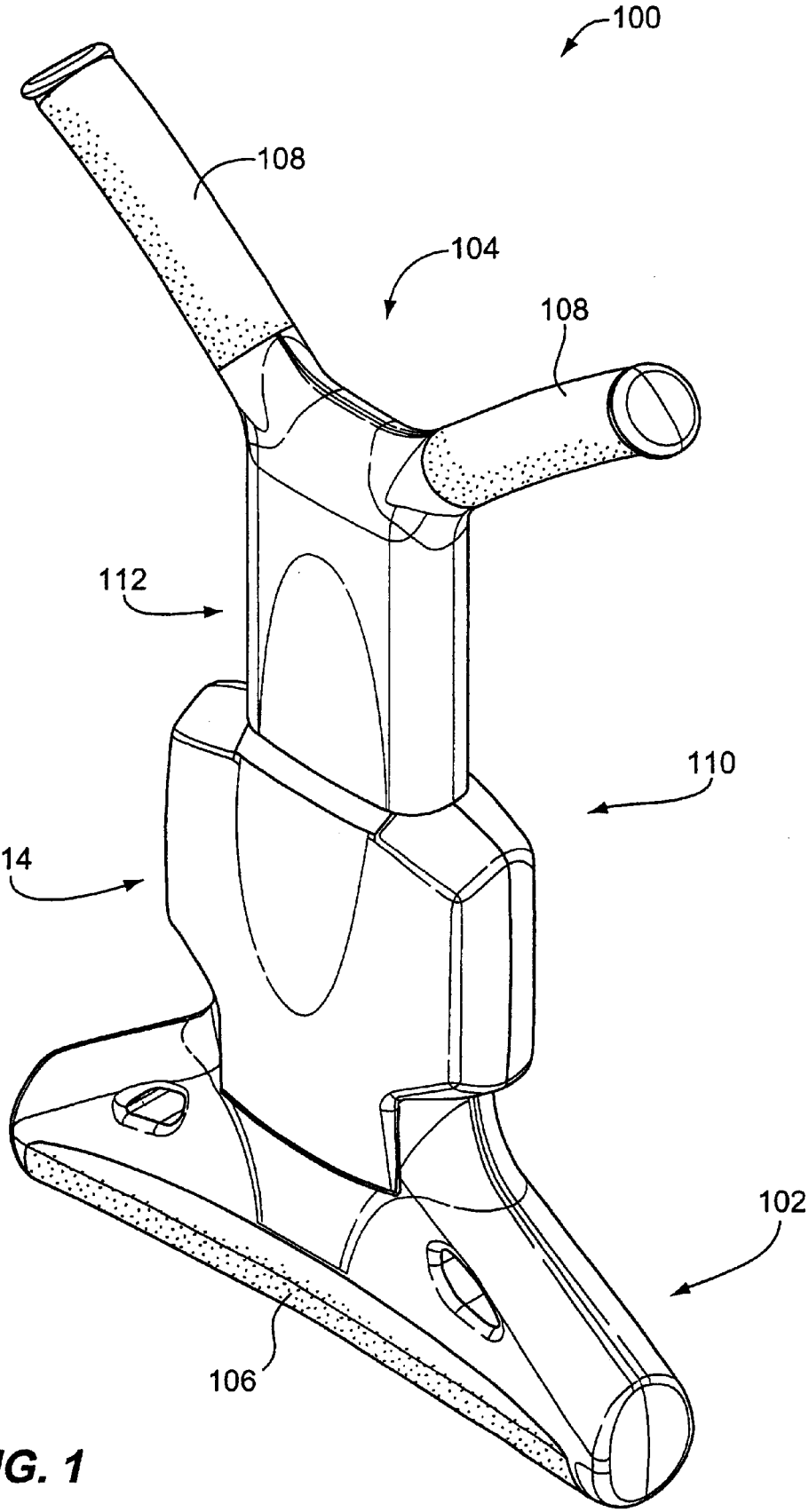
FIG. 1 depicts a perspective view of the preferred embodiment of the compact abdominal exercise apparatus.

FIG. 1 depicts a perspective view of the preferred embodiment of the compact abdominal exercise apparatus 100. The compact abdominal exercise apparatus 100 includes a lower body support 102 and an upper body support 104. The lower body support 102 and upper body support 104 slide within each other as depicted in FIGS. 1–5, 9, and 11–13. The lower body support 102 is connected to a lower body support pad 106. The upper body support 104 includes handles 108 for a user to grasp. The compact abdominal exercise apparatus 100 includes an upper body support 104 and lower body support 102 connector assembly 110.

Figure 2:
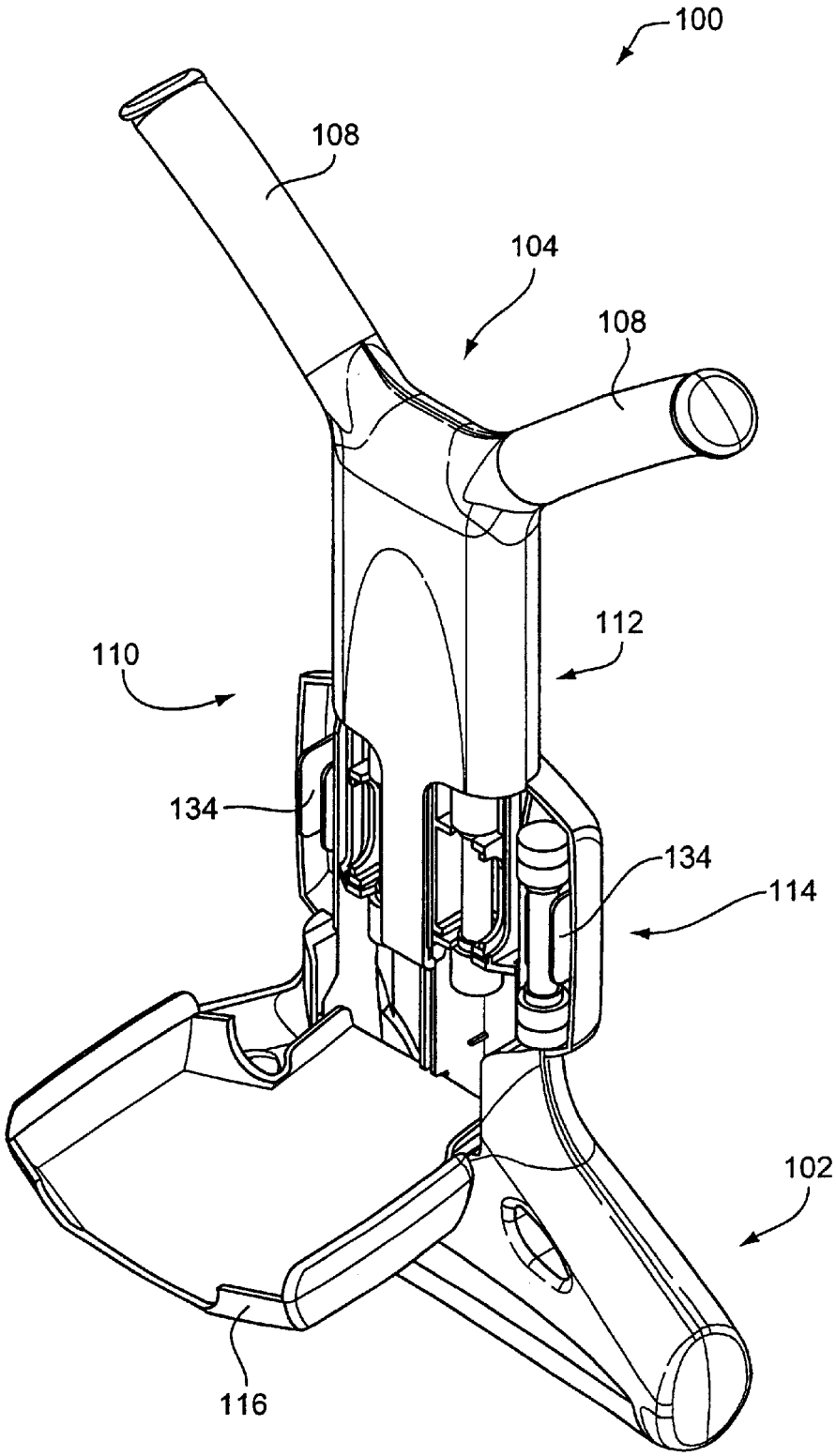
FIG. 2 depicts a perspective view of the preferred embodiment of the compact abdominal exercise apparatus with the protective cover open.
Figure 3:
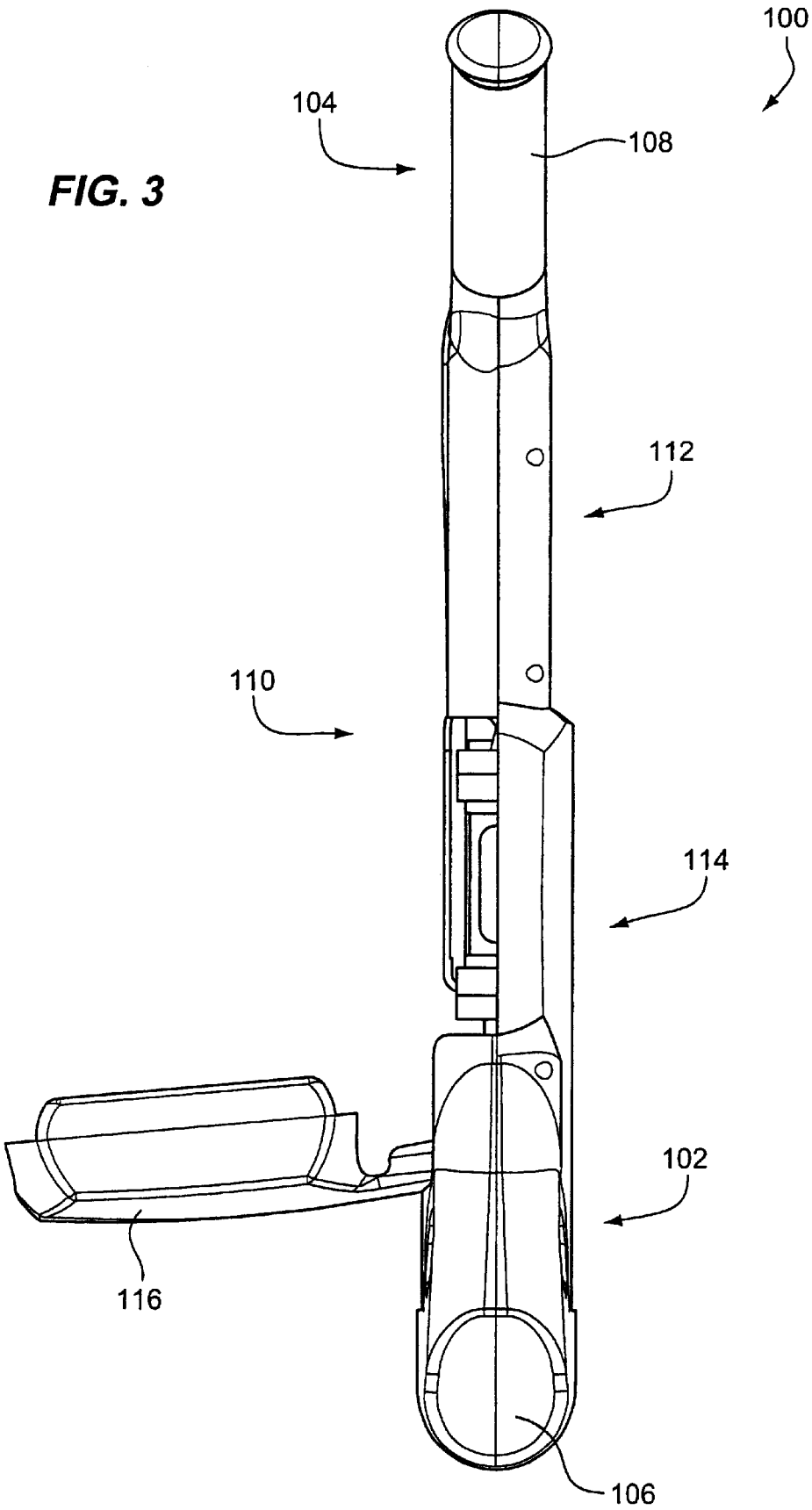
FIG. 3 depicts a side view of the preferred embodiment of the compact abdominal exercise apparatus with the protective cover open.

The connector assembly 110 includes a first member 112 and a second member 114 that interconnect to provide a compact abdominal exercise apparatus 100 that provides crunching abdominal exercises to a user. FIG. 2 depicts a perspective view of the preferred embodiment of the compact abdominal exercise apparatus with the protective cover 116 open. The connector assembly 110 is exposed when the protective cover 116 is open. Further, FIGS. 3 and 4 depict a side view and front view of the preferred embodiment of the compact abdominal exercise apparatus with the protective cover 116 open.

Figure 4:
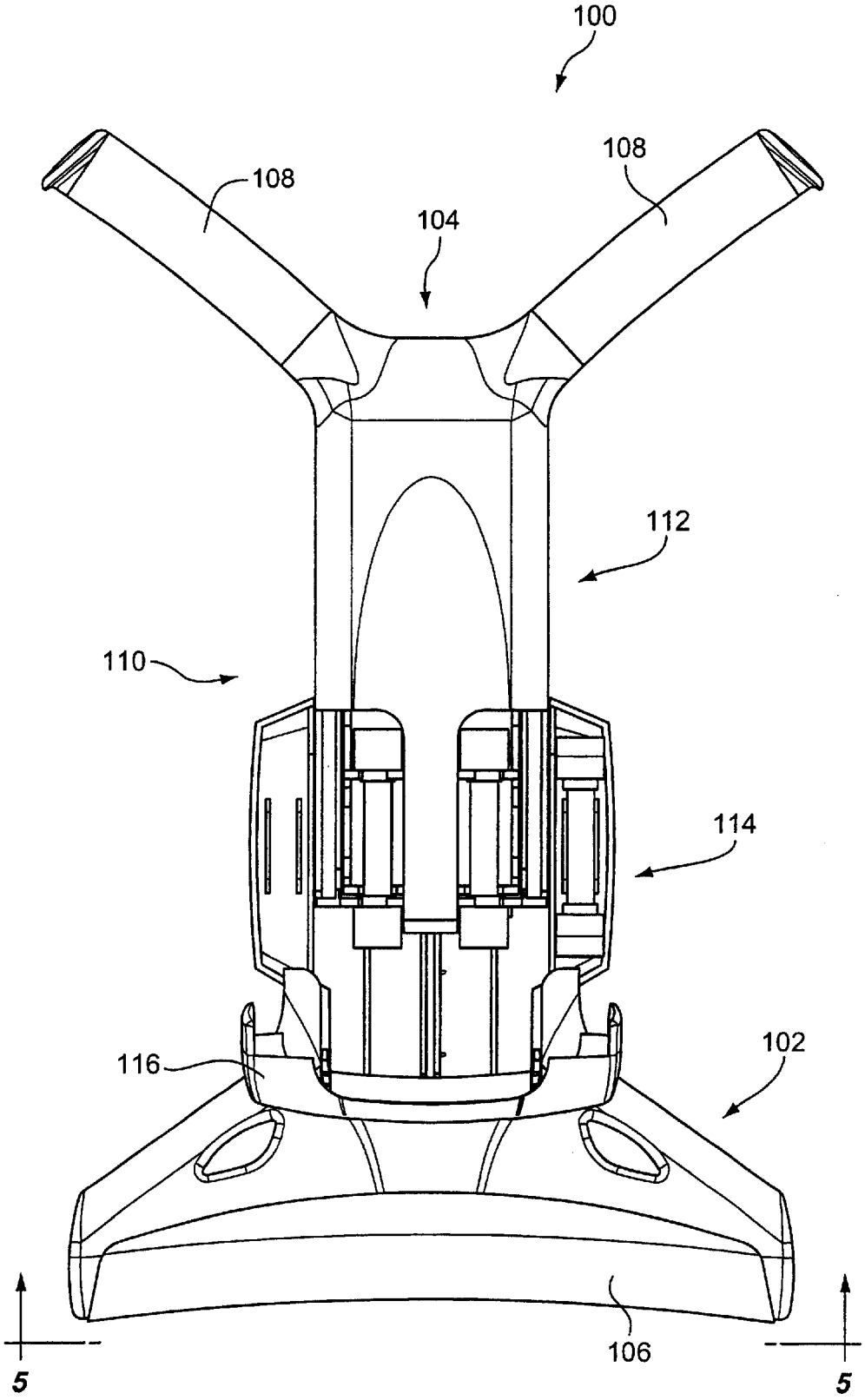
FIG. 4 depicts a front view of an embodiment of the compact abdominal exercise apparatus with the protective cover open.
Figure 5:
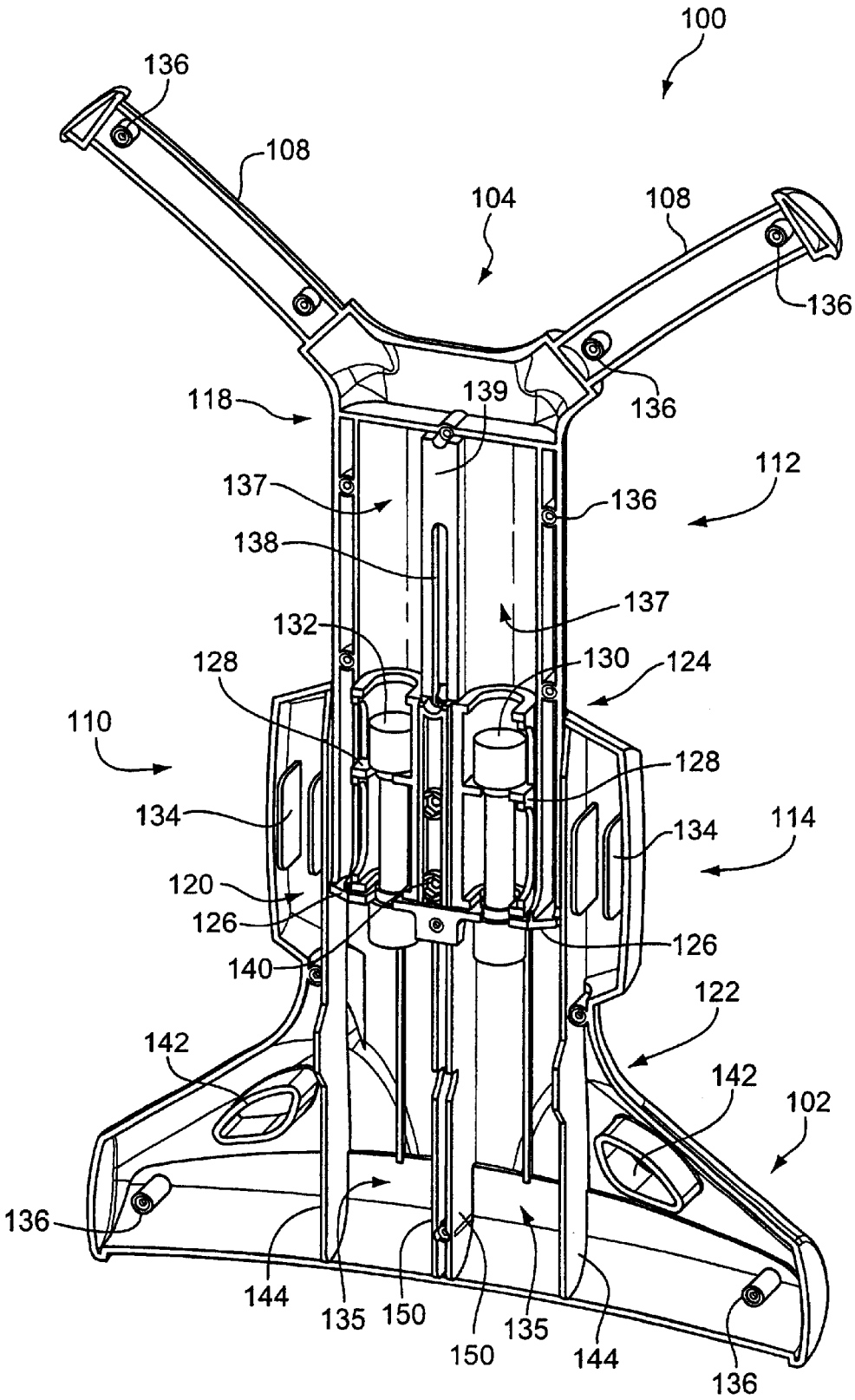
FIG. 5 depicts a cross-section view of the preferred embodiment of the compact abdominal exercise apparatus.

FIG. 5 depicts a cross-section view through the lines 5—5 of FIG. 4 of the preferred embodiment of the compact abdominal exercise apparatus 100. The first member 112 includes a first member proximal end 118 and a first member distal end 120. The second member 114 includes a second member proximal end 122 and a second member distal end 124. The first member 112 also includes a first elastic anchor member 126 that is connected to the first member 112 in the proximity of the first member distal end 120. The second member 114 also includes a second elastic anchor member 128 connected to the second member 114 in the proximity of the second member distal end 124. The first elastic anchor member 126 and the second elastic anchor member 128 are connected together by a first elastic member 130. Preferably, a second elastic member 132 is employed to add increased resistance during operation of the compact abdominal exercise apparatus. Preferably, additional elastic members are stored in optional spare elastic member ribs 134 located adjacent to the location of second elastic anchor member 128 or elsewhere, where space exists to store additional elastic members.

Figure 8:
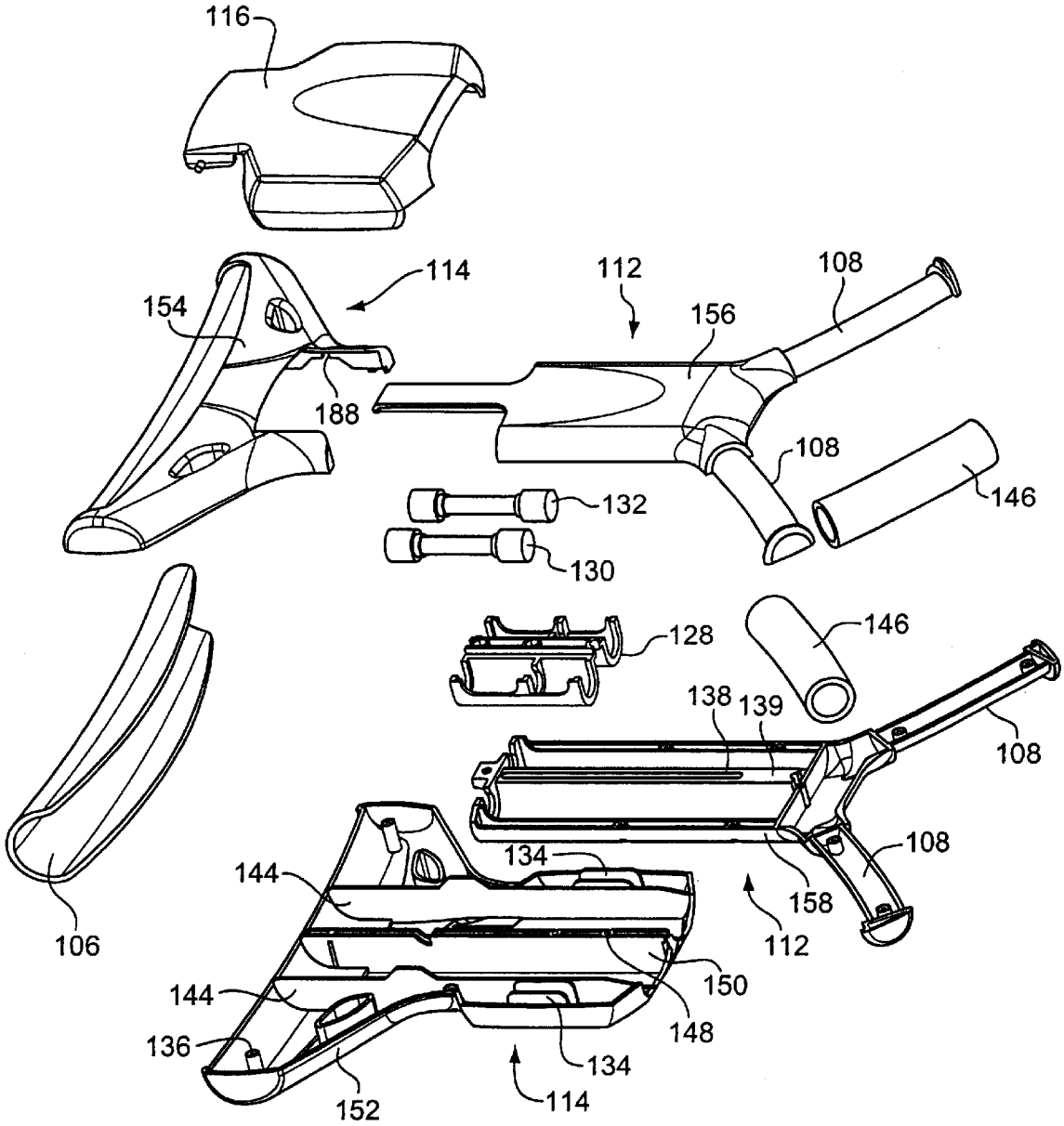
FIG. 8 depicts an exploded view of the preferred embodiment of the compact abdominal exercise apparatus.

When the first member 112 or second member 114 are molded into two or more pieces as shown in FIGS. 2–5, the pieces can be held together by fasteners, such as screws that screw into screw bosses 136, located in various locations on the first member 112 and the second member 114. In the preferred embodiment of the present invention, the first member 112 includes first member channels 137 that are formed to fit the second elastic anchor member 128. The slot 138 allows fasteners, such as the second anchor member fasteners 140, to fasten the second elastic anchor member 128 to the second member 114 while allowing the first member 112 to slideably move between the second elastic anchor member 128 and the second member 114. The slot 138 allows the first member 112 to slideably move relative to the second member 114, when the second elastic anchor member 128 is attached to the second member 114. The first member 112 also includes a first member ridge 139 that is formed to fit between the second elastic anchor member 128 and the second member 114. The second elastic member 132 is attached to the second member 114 by elastic anchor member fasteners 140. Vent holes 142 equilibrate the air pressure within the compact abdominal exercise apparatus 100 during use by a user. The second member 114 includes second member outer channels 144 that guide the first member 112 to slideably move relative to the second member 114. The second member 114 also includes second member inner channels 150 that guide the first member 112 to slideably move relative to the second member 114. The second member channels 135 are defined by the area between the second member outer channels 144 and the second member inner channels 150. Preferably, the second member 114 is molded into one, two, or more pieces. In FIG. 8, a two-piece second member 114 is shown.

Figure 6:
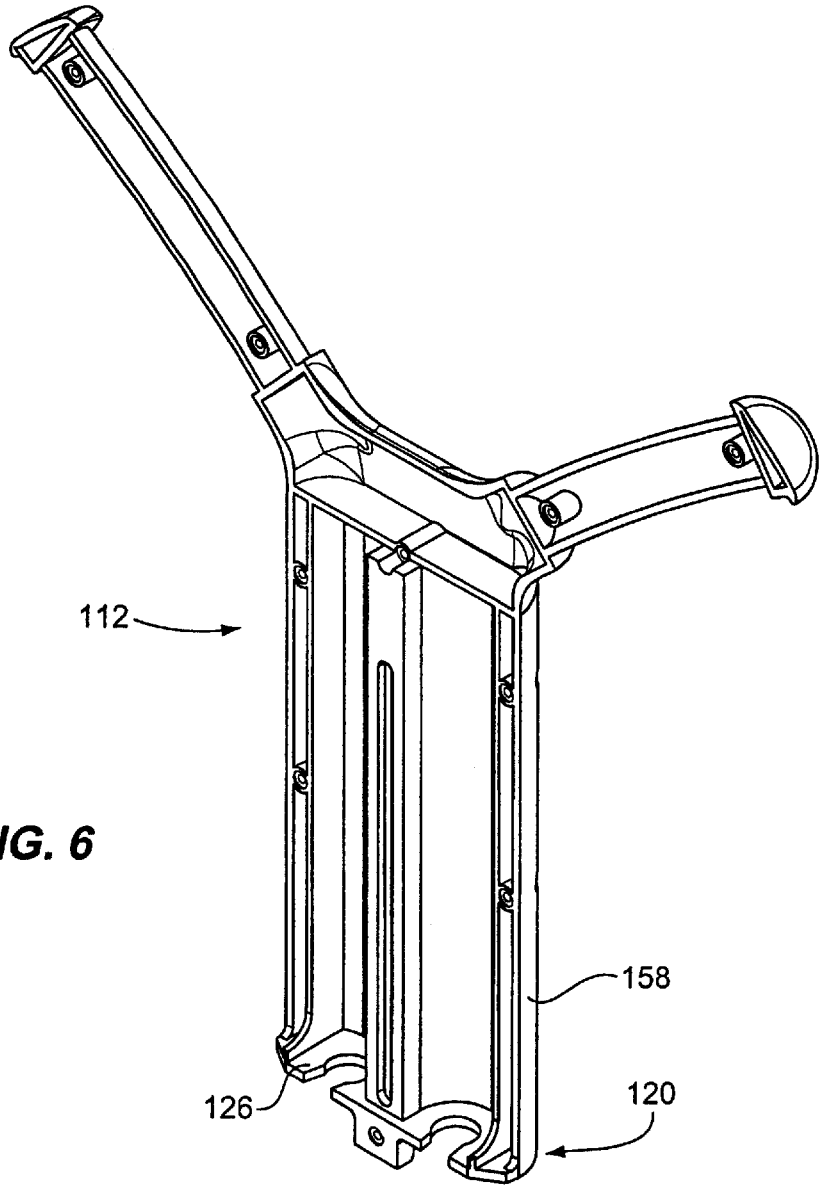
FIG. 6 depicts a perspective view of the back first member of the preferred embodiment of the compact abdominal exercise apparatus.
Figure 7:
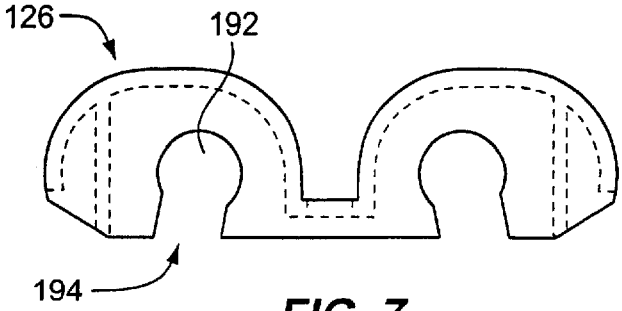
FIG. 7 depicts an end view of the first elastic anchor member of the preferred embodiment of the compact abdominal exercise apparatus.

FIG. 6 depicts a perspective view of the back first member 158 of the preferred embodiment of the compact abdominal exercise apparatus 100. Near the proximity of the first member distal end 120 is the first elastic anchor member 126 which holds one end of the elastic members 130, 132, and 160. FIG. 7 depicts an end view of the first elastic anchor member 126 of the preferred embodiment of the compact abdominal exercise apparatus 100. The first elastic anchor member 126 includes a first elastic anchor member hole 192 and a first elastic anchor member opening 194. The first elastic anchor member opening 194 is sized slightly smaller than the first elastic anchor member hole 192 to allow the elastic member body 190 to fit through but not the elastic member end, thereby creating a catch for the elastic members 130 ,132, and 160.

FIG. 8 depicts an exploded view of the preferred embodiment of the compact abdominal exercise apparatus 100. Preferably, the handles 108 are covered with optional handle covers 146. The second member 114 includes second elastic anchor member mounts 148 for accepting the second elastic anchor member fasteners 140. The second member 114 also includes second member inner channels 150 that guide the first member 112 to slideably move relative to the second member 114. Preferably, the second member 114 is molded into one, two, or more pieces. In FIG. 8, a two-piece second member 114 is shown. Second member 114 includes a back second member 152 and a front second member 154. Preferably, the first member 112 is molded into one, two, or more pieces. In FIG. 8, a two-piece first member 112 is shown. First member 112 includes a front first member 156 and a back second member 158.

Figure 9:
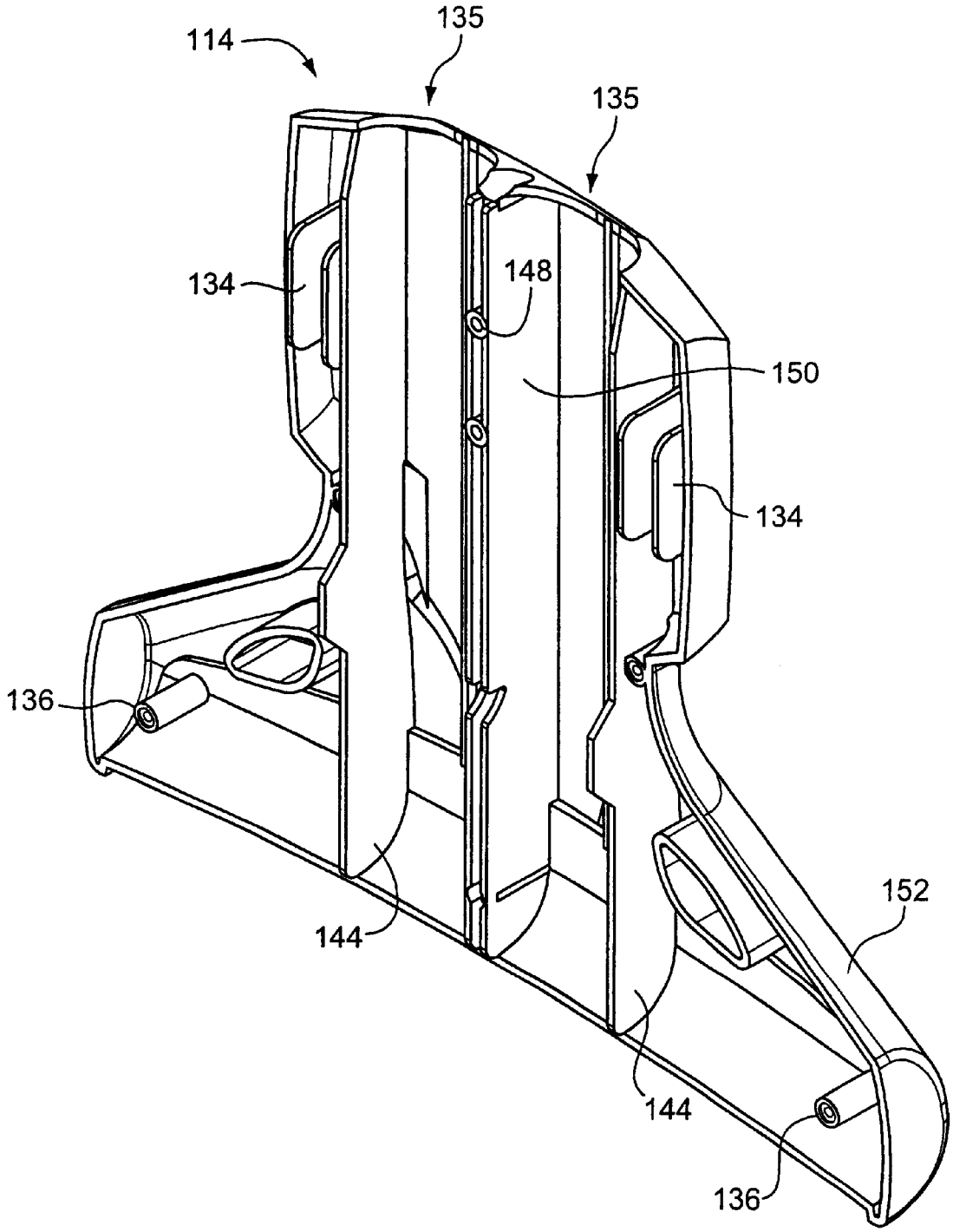
FIG. 9 depicts a perspective view of the preferred embodiment of the back second member.
Figure 10:
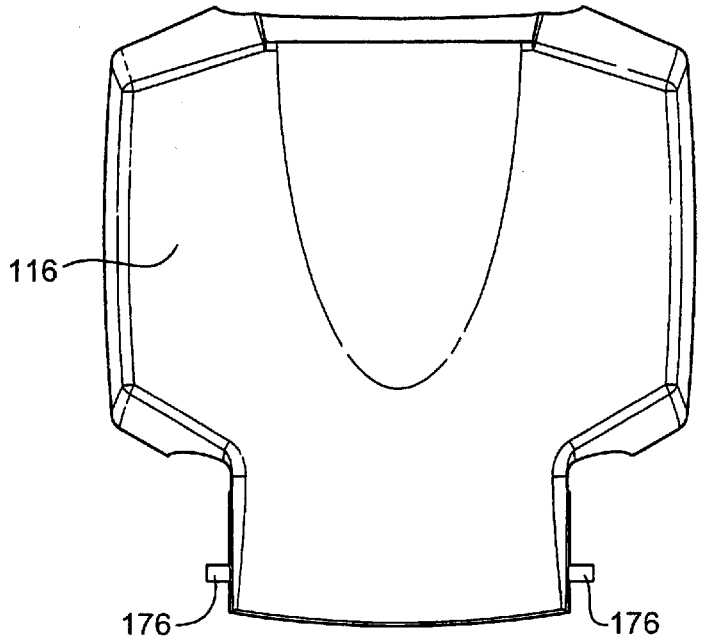
FIG. 10 depicts a front view of an embodiment of the protective cover.
Figure 11:
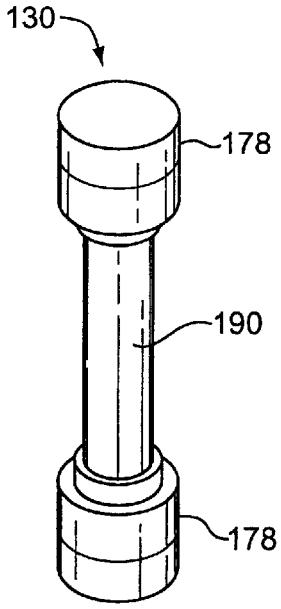
FIG. 11 depicts a perspective view of an embodiment of an elastic member.

FIG. 9 depicts a perspective view of the preferred embodiment of the back second member 152. The back second member 152 includes second member channels 135 defined by the second member outer channels 144 and the second member inner channels 150. FIG. 10 depicts a front view of an embodiment of the protective cover 116. In the preferred embodiment of the present invention, the protective cover 116 attaches to the front second member 154 of the second member 114. The protective cover 116 includes protective cover hinge tabs 170 that fit into front second member holes 188, as depicted in FIG. 10, in the second member 114. FIG. 11 depicts a perspective view of an embodiment of the elastic members 130 and 132. Preferably, the first elastic member 130 and second elastic member 132 include a slightly larger end such as elastic member end 178 that preferably is larger in size than the elastic member body 190 and the second elastic anchor member opening 180, as depicted in FIG. 12.

Figure 12:
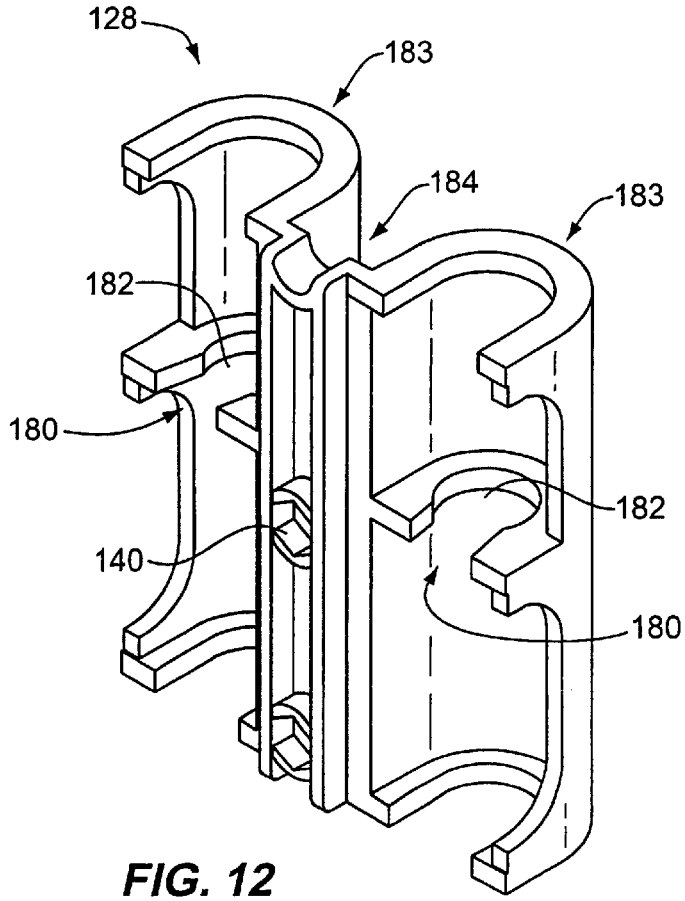
FIG. 12 depicts a perspective view of an embodiment of a second elastic anchor member.

FIG. 12 depicts a perspective view of an embodiment of a second elastic anchor member 128. In an embodiment of the present invention, the second elastic anchor member 128 includes an indent or recessed area, such as the second elastic anchor member indent 184. In this embodiment, the second elastic anchor member indent 184 of the second elastic anchor member 128 is formed to fit next to the first member ridge 139. The second elastic anchor member 128 also includes a curved area that fits within the first member channels 137, such as the second elastic anchor member curved portion 183. The second elastic anchor member 128 also includes a second elastic anchor member opening 180. The second elastic anchor member opening 180 is sized to allow the elastic member body 190 to fit within the opening. The second elastic anchor member 128 also includes a second elastic anchor member upper catch 182 that is sized to allow the elastic member body 190 to fit within the opening, but the opening is a smaller size than the elastic member end 178 of the elastic members 130 and 132 to be a catch and hold the elastic members 130 and 132 in position as the compact abdominal exercise apparatus 100 is used.

Figure 13:
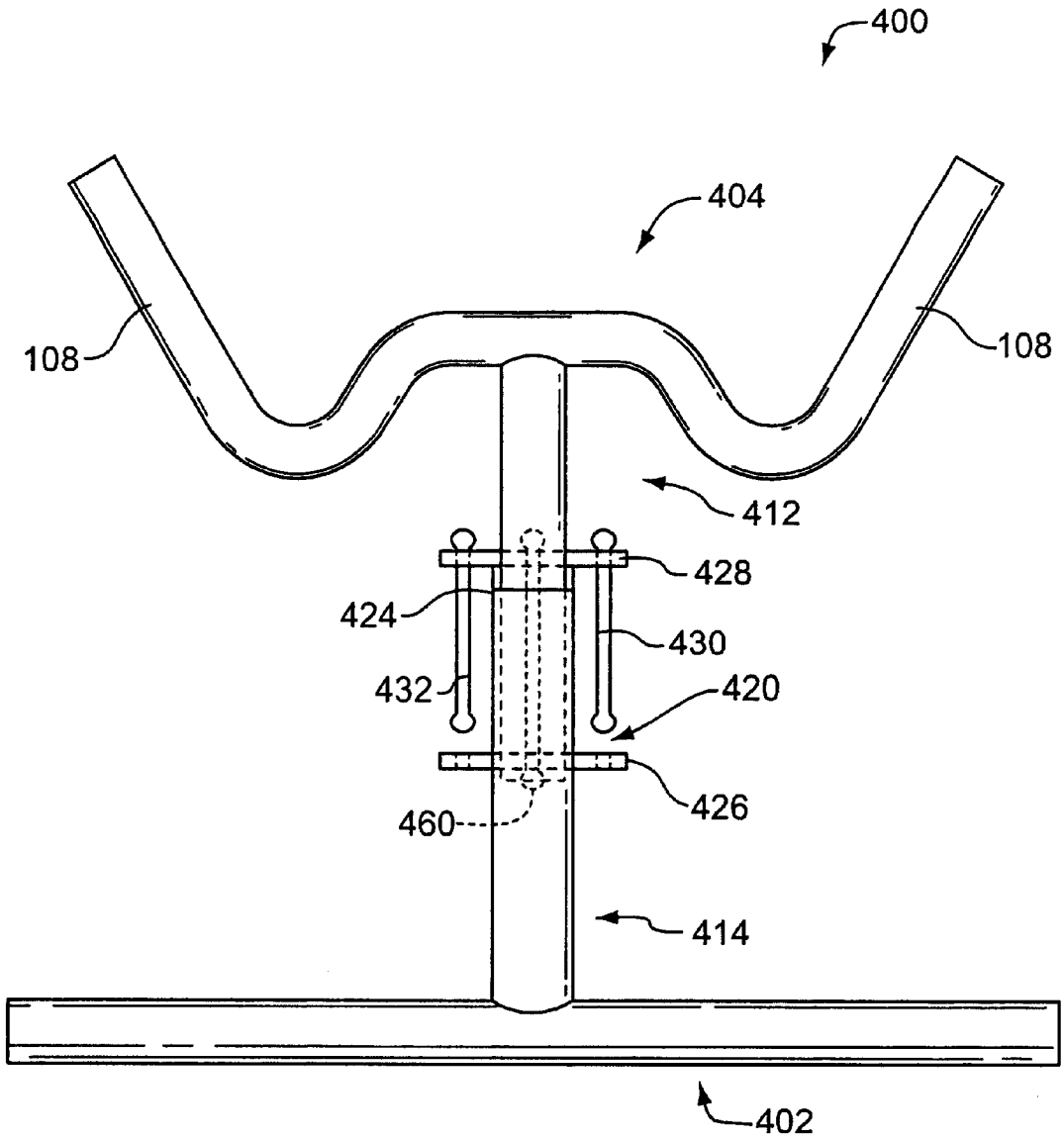
FIG. 13 depicts a front view of another embodiment of the compact abdominal exercise apparatus.

FIG. 13 depicts a front view of another embodiment 400 of the compact abdominal exercise apparatus. In this embodiment, the compact abdominal exercise apparatus 400 includes an upper body support 404 connected to the first member 412 and a lower body support 402 connected to the second member 414. The compact abdominal exercise apparatus 400 includes a lower body support 402 that is placed on top of a user's thighs and an upper body support 404 including handles 408 that are grasped ergonomically by a user's hands. In this embodiment, the first member 412 and the second member 414 are of a tubular configuration. Preferably, the tubular configuration is cylindrical or a pipe or cylinder that has a cross-section of a square, rectangle, pentagon, hexagon, or other geometric shapes. The second elastic anchor member 428 is attached in the proximity of the second member distal end 424. The first elastic anchor member 426 is attached to the proximity of the first member distal end 420. FIG. 13 depicts an optional third elastic member 460 connected between the second elastic anchor member 428 and the first elastic anchor member 426. The second elastic member 432 and the first elastic member 430 are depicted connected to the second elastic anchor member 428 but not the first elastic anchor member 426. In this embodiment, the size or diameter of the first member 412 is slightly less than the size or diameter of the second member 414, to enable the first member 412 to slideably move within the second member 414.

The first member proximal end 418 is the same end that the handles 408 are attached to the first member 412. The first member distal end 420 is the opposite end from the first member proximal end 418 of the first member 412. The second member proximal end 422 is the same end that the lower body support 402 is attached to the second member 414. The second member distal end 424 is the opposite end from the second member proximal end 422 of the second member 414.

Preferably, elastic members 430, 432, and 460 are made of rubber or some other elastic material. Preferably, elastic members 430, 432, and 460 have ends that are of a larger size or diameter than the second elastic anchor member 428 and the first elastic anchor member 426 openings. Preferably, elastic members 430, 432, and 460 are elastic bands or elastic rubber bands.

Figure 14:
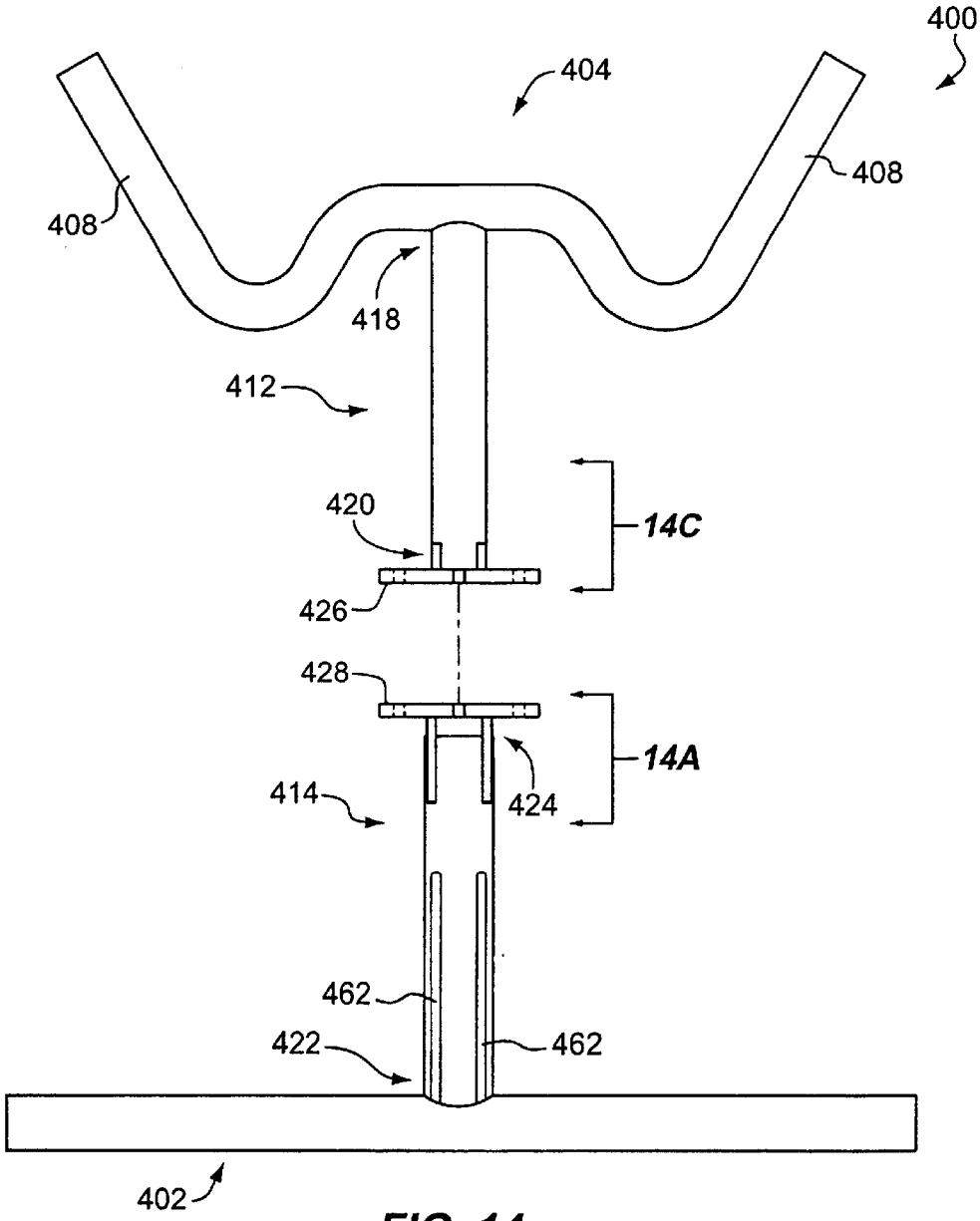
FIG. 14 depicts an exploded view of the embodiment depicted in FIG. 13 of the compact abdominal exercise apparatus.
Figure 14A:
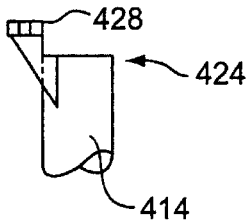
FIG. 14A depicts a side view of the second elastic anchor member as depicted in the embodiment in FIG. 13 of the compact abdominal exercise apparatus.
Figure 14B:
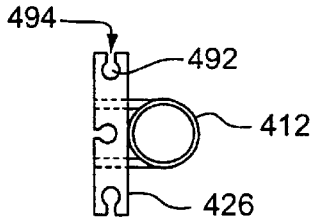
FIG. 14B depicts a top view of the first elastic anchor member as depicted in the embodiment in FIG. 13 of the compact abdominal exercise apparatus.
Figure 14C:
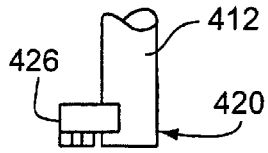
FIG. 14C depicts a side view of the first elastic anchor member as depicted in the embodiment in FIG. 13 of the compact abdominal exercise apparatus.

FIG. 14 depicts an exploded view of the embodiment depicted in FIG. 13 of the compact abdominal exercise apparatus 400. The first member 412 and second member 414 are separated to depict second member slots 462. Preferably, there are one, two, or more second member slots 462 and in FIG. 15, two are shown. The first elastic anchor member 426 protrudes through these second member slots 462 when the first member 412 and second member 414 are slid together as shown in FIG. 13. FIGS. 14A–14C depict various views of the first elastic anchor member 426 and the second elastic anchor member 428.

FIG. 14A depicts a portion of the second member distal end 424 of the second member 414 and the second elastic anchor member 428 that is attached to the second member distal end 424. In FIG. 14B, the first member 412 is shown from a distal end view. The first elastic anchor member 426 is shown attached to the first member distal end 420 of the first elastic anchor member 426. The first elastic anchor member holes 492 of the first elastic anchor member 426 are shown with a narrower opening than the first elastic anchor member hole 492 diameter to facilitate the holding of the first elastic member 430, second elastic member 432, and third elastic member 460. As in the embodiment described above, these elastic members 430, 432, and 460 preferably have an elastic member end 478 that is a greater diameter than the elastic member body 490, thereby enabling a user to easily connect and disconnect the elastic members 430, 432, and 460 from the first elastic anchor member 426 and second elastic anchor member 428. Though FIG. 14B depicts the first elastic anchor member 426, the size of first elastic anchor member holes 492 and dimension of the first elastic anchor member 426, the second elastic anchor member 428 preferably possesses these same first elastic anchor member hole 492 sizes and dimensions. FIG. 14C depicts a portion of the first member distal end 420 of the first member 412 and the first elastic anchor member 426 that is attached to the first member distal end 420.

Figure 15:
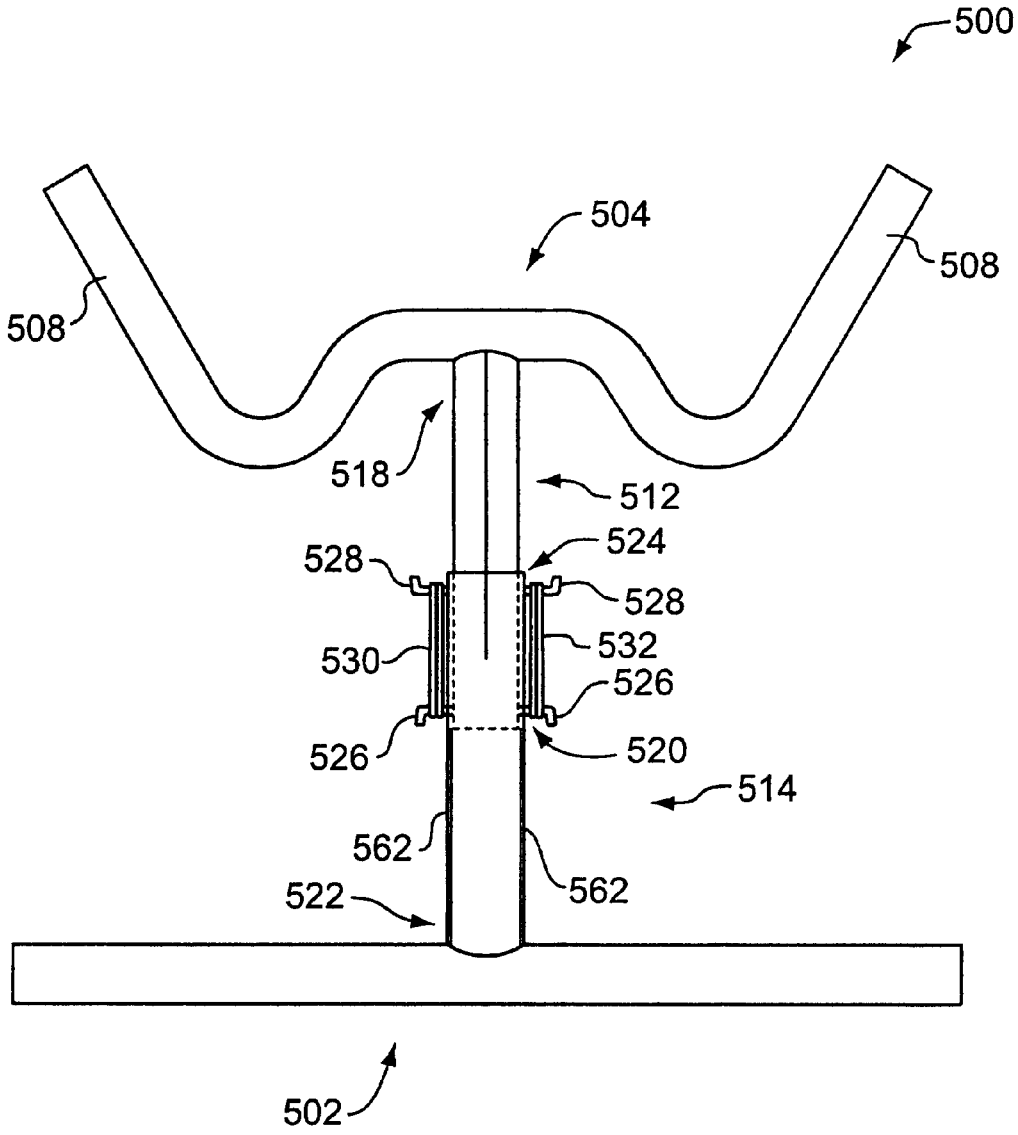
FIG. 15 depicts a front view of another embodiment of the compact abdominal exercise apparatus.

FIG. 15 depicts a front view of another embodiment 500 of the compact abdominal exercise apparatus. In this embodiment, the compact abdominal exercise apparatus 500 includes an upper body support 504 connected to the first member 512 and a lower body support 502 connected to the second member 514. The compact abdominal exercise apparatus 500 includes a lower body support 502 that is placed on top of a user's thighs and an upper body support 504 including handles 508 that are grasped ergonomically by a user's hands.

The first member proximal end 518 is the same end that the handles 508 are attached to the first member 512. The first member distal end 520 is the opposite end from the first member proximal end 518 of the first member 512. The second member proximal end 522 is the same end that the lower body support 502 is attached to the second member 514. The second member distal end 524 is the opposite end from the second member proximal end 522 of the second member 514.

In this embodiment, the first member 512 and the second member 514 are of a tubular configuration. The tubular configuration preferably is cylindrical or pipe or cylinder that has a cross-section of a square, rectangle, pentagon, hexagon, or other geometric shapes. The second elastic anchor member 528 is attached in the proximity of the second member distal end 524. The first elastic anchor member 526 is attached to the proximity of the first member distal end 520. In this embodiment, the size or diameter of the first member 512 is slightly less than the size or diameter of the second member 514, to enable the first member 512 to slideably move within the second member 514.

Preferably, elastic members 530, 532, and 560 are made of rubber or some other elastic material. Preferably, elastic members 530, 532, and 560 have ends or are shaped to allow the second elastic anchor member 528 and the first elastic anchor member 526 to hold elastic members 530, 532, and 560. Preferably, elastic members 530, 532, and 560 are elastic bands or elastic rubber bands.

The second member 514 includes second member slots 562. Preferably, there are one, two, or more second member slots 562 and in FIG. 15, two are shown. The first elastic anchor member 526 protrudes through these second member slots 562 when the first member 512 and second member 514 are slid together as shown in FIG. 15.

In this embodiment, the first elastic anchor member 526 and second elastic anchor member 528 are configured to hold a first elastic member 530 and a second elastic member 532 that are elastic bands, like heavy-duty rubber bands designed for exercise apparatuses. In FIG. 15, the first elastic anchor member 526 and second elastic anchor member 528 are shown being capable of connecting two elastic members. The first elastic anchor member 526 and second elastic anchor member 528 could be such that they support one, two, or more elastic members.

Figure 16:
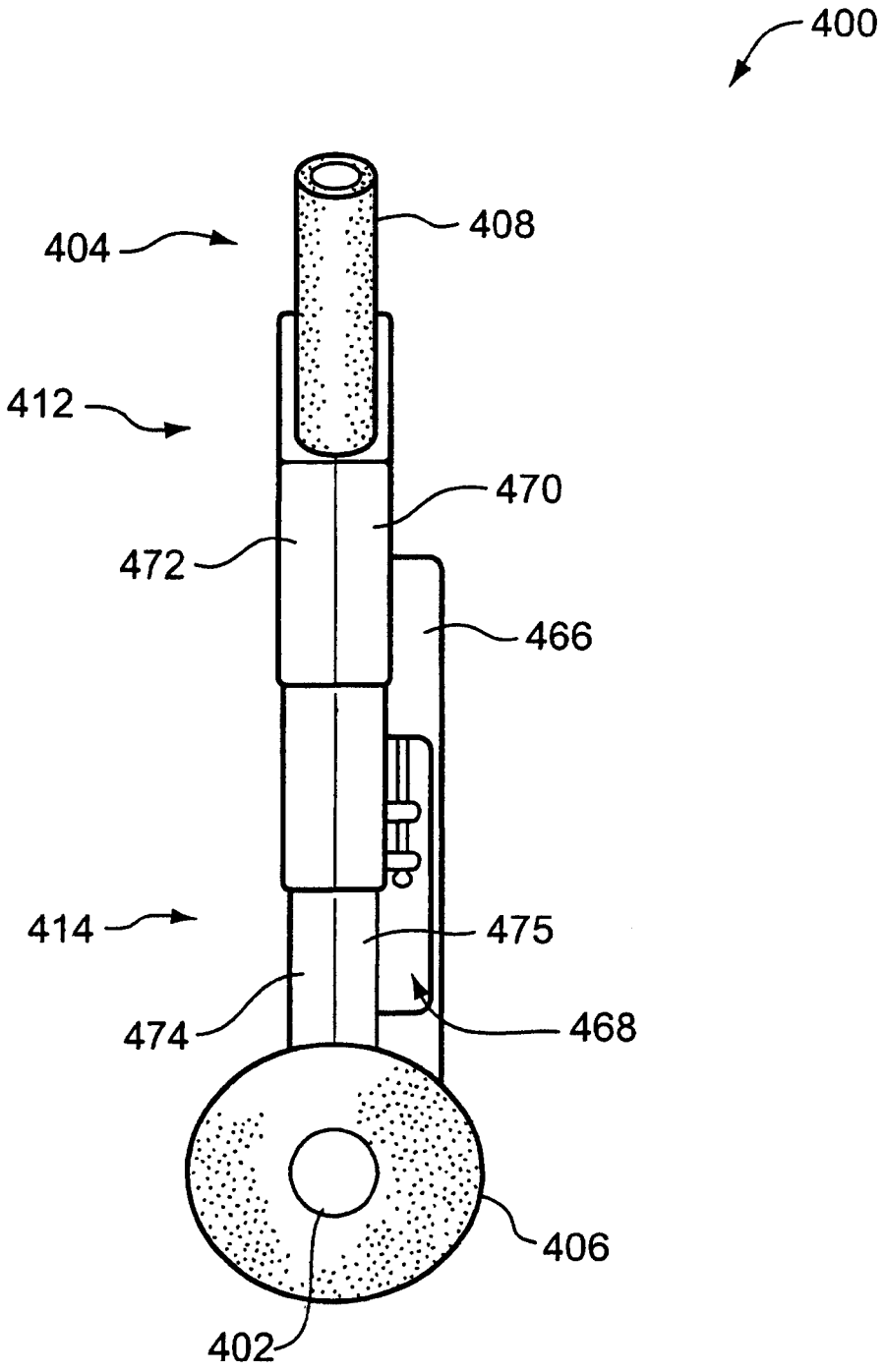
FIG. 16 depicts a side view of the embodiment depicted in FIGS. 13–15 of the compact abdominal exercise apparatus with molded covers covering the internal mechanical features.
Figure 17:
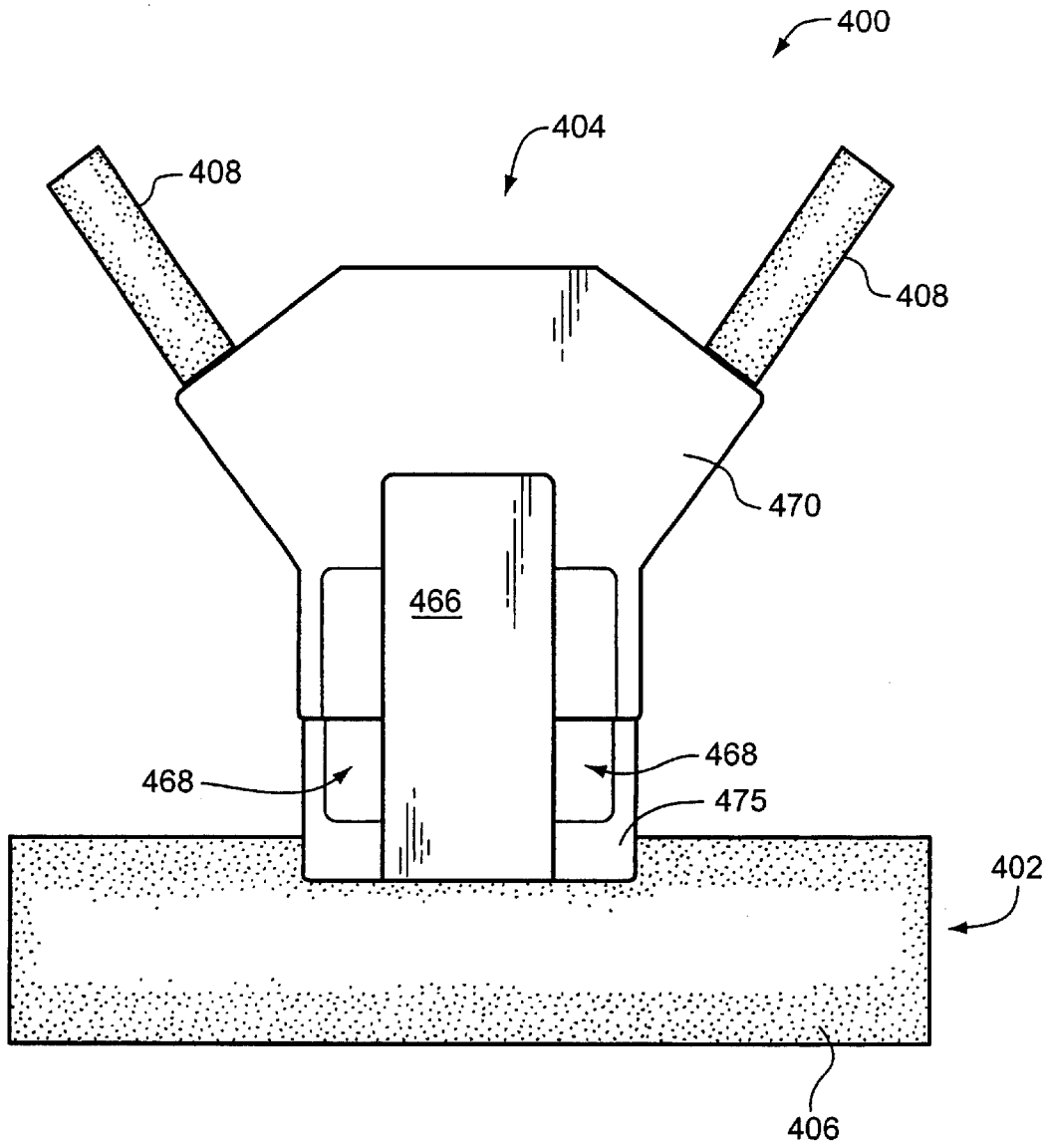
FIG. 17 depicts a rear view of the embodiment depicted in FIGS. 13–15 of the compact abdominal exercise apparatus.

FIG. 16 depicts a side view of the embodiments depicted in FIGS. 13–15 of the compact abdominal exercise apparatus 100 with molded covers covering the internal mechanical features. The compact abdominal exercise apparatus 100 includes an upper front protective cover 472 and an upper rear protective cover 470 that cover some of the internal mechanical features, as depicted in FIGS. 13–15. The compact abdominal exercise apparatus 100 also includes lower front protective cover 474 and a lower back protective cover 475 that covers some of the internal mechanical features. A slotted protective access cover 466 has a quick access opening 468 to allow access to elastic members 430, 432, 460, 530, 532, and 560. FIG. 17 depicts a rear view of the embodiments depicted in FIGS. 13–16 of the compact abdominal exercise apparatus 100.

Figure 18B:
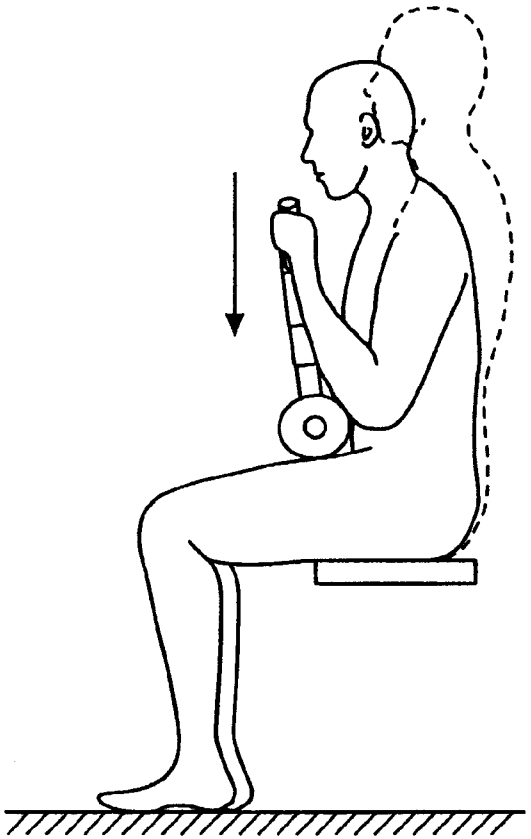
FIGS. 18A and 18B depict a side view demonstrating a user in a sitting position exercising with the compact abdominal exercise apparatus.
Figure 18A:
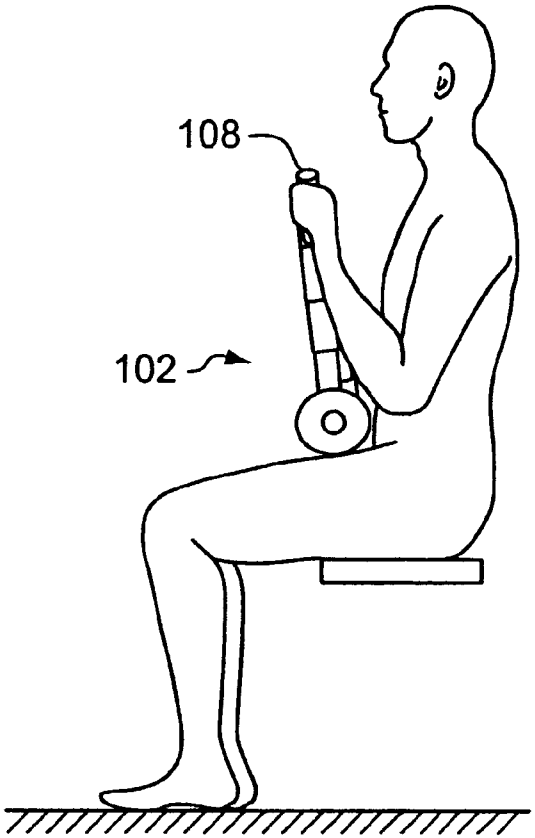
Figure 19:
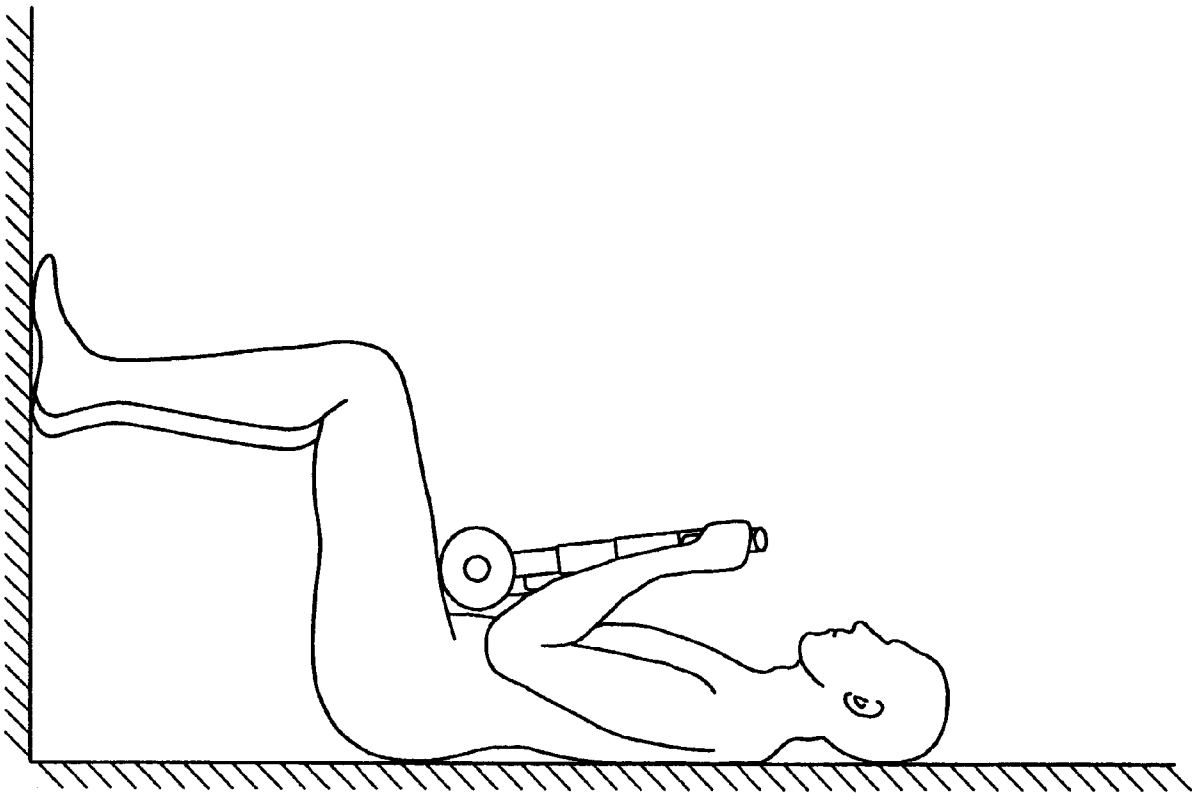
FIG. 19 depicts a side view demonstrating a user in a supine position lying on their back with their feet against a wall exercising with the compact abdominal exercise apparatus.

FIGS. 18A and 18B depict a side view demonstrating a user in a sitting position exercising with the compact abdominal exercise apparatus 100. In FIG. 18A, a user is depicted in an upright seated position with the lower body support 102, 402, and 502 in contact with the tops of the users thighs and the users hands are grasping the handles 108, 408, and 508. In FIG. 18B, the user is in the crunched position. In FIG. 19, a user is depicted in a supine position with the user's back flat against the floor and their feet against a wall. The lower body support 102, 402, and 502 is in contact with the thighs and the users hands are grasping the handles 108, 408, and 508.

The compact abdominal exercise apparatus 100 is ergonomically designed to be comfortable to a user. The handles 108, 408, and 508 are angled to facilitate a comfortable grasp of the user during use of the compact abdominal exercise apparatus 100. Further, the handle covers 146 and lower body support pad 106, 406, and 506 are composed of foam, or alternatively other soft materials such as plastic, rubber or Styrofoam. In addition, the lower body support 102, 402, and 502 is wide enough to be supported by two thighs of a user. Preferably, the width of the, lower body support 102 is between 8 and 20 inches. Most preferably, the width of the lower body support 102 is 13 inches. The span of the handles 108 is preferably between 5 and 30 inches, and most preferably 14 inches. Preferably, the height of the lower body support 102 is between 1 inch and 14 inches, and most preferably 6 inches. Preferably, the height of the upper body support 104 is between 2 inches and 12 inches, and most preferably 8 inches. The upper body support 104, lower body support 102, first member 112, and second member 114 are composed of plastic, or alternatively other rigid lightweight materials such as plexiglass, polymeric materials, wood, aluminum, and carbon.

In the preferred embodiment, the protective cover 116 is hingeable and rotates about protective cover hinge tabs 176. In another embodiment, the protective cover 116 preferably contains access holes or portions to enable a user to change the elastic members 130, 132, and 160 without rotating the protective cover 116. The protective cover 116 is made of the same or different material than the first member 112 and second member 114 as described above.

The first member proximal end 118 is the same end that the handles 108 are attached to the first member 112. The first member distal end 120 is the opposite end from the first member proximal end 118 of the first member 112. The second member proximal end 122 is the same end that the lower body support 102 is attached to the second member 114. The second member distal end 124 is the opposite end from the second member proximal end 122 of the second member 114.

In the preferred embodiment, the first elastic member anchor 126 and second elastic member anchor 128 preferably hold one, two, or more elastic members 130, 132, and 160. The first elastic member anchor 126 is located in the proximity of the first member distal end 120. The second elastic member anchor 128 is located in the proximity of the second member distal end 124. As a user increases the compressive force on the first member 112 towards the second member 114 during exercise, the distance between the first elastic member anchor 126 and the second elastic member anchor 128 increases, thereby increasing the tensile stress on the elastic members 130, 132, and 160. Conversely, as a user decreases the compressive force on the first member 112 towards the second member 114, the distance between the first elastic member anchor 126 and the second elastic member anchor 128 decreases, thereby decreasing the tensile stress on the elastic members 130, 132, and 160.

The upper body support and lower body support connector assembly 110 can be configured in a variety of embodiments. The connector assembly 110 includes the first member 112 and the second member 114, whereby the first member 112 and the second member 114 slide past each other relatively to enable a compressive type movement. In one embodiment and as would be known to those skilled in the art, the first member 112 is attached to the upper body support 104 and the second member 114 is attached to the lower body support 102. In another embodiment, the first member 112 preferably is attached to the lower body support 102 and the second member 114 preferably is attached to the upper body support 104.

The compact abdominal exercise apparatus 100 preferably includes one, two, or more elastic members. In the preferred embodiment, the compact abdominal exercise apparatus 100 includes a first elastic member 130 and a second elastic member 132. In another embodiment of the present invention, there preferably is a third elastic member 160. The elastic members 130, 132, and 160 are rubber tubing or other material capable of creating a resistive force upon stretching. Alternatively, other elastic members could be other resistive forces, such as hook and ring ends for springs, compressed gas pistons, an air bag compressed by a plunger, compressed or extended coil springs, stretching a band that is mounted sideways with a hook or roller, compressing a foam or elastomer spring or donut, a torsion spring like a tape measure, flat elastic band style spring, a scissor arrangement, and handles attached to an air bag.

In the preferred embodiment, the elastic members 130, 132, and 160 have an elastic member end 178 at one or both ends of the elastic members 130, 132, and 160. The elastic member end 178 allows a user to quickly connect and disconnect the elastic members 130, 132, and 160 from the first elastic member anchor member 126 and second elastic member anchor member 128. The elastic member end 178 of the elastic members 130, 132, and 160 preferably are of a large diameter or size to facilitate connection to the first elastic member anchor member 126 and second elastic member anchor member 128. The elastic member body 190 preferably is of a size that is smaller than the elastic member end 178 to slide through the first elastic anchor member holes 192.

The first elastic anchor member holes 192 in the first elastic member anchor member 126 and second elastic member anchor member 128 preferably are one, two, or more. In one embodiment, there are two first elastic anchor member holes 192 in the first elastic member anchor member 126 and second elastic member anchor member 128; and in another embodiment of the present invention, there are three first elastic anchor member holes 192 in the first elastic member anchor member 126 and second elastic member anchor member 128. The optional spare elastic member ribs 134 hold additional elastic members that are not in use, as shown in FIG. 2. Alternatively, the first elastic anchor member 126 and second elastic anchor member 128 preferably comprise a hook type of arrangement, such that it accepts elastic members that are capable of being attached to this hook type of arrangement.

As described above, the compact abdominal exercise apparatus 100 preferably comprises a variety of molded pieces that are assembled into one unit. The molded pieces preferably are fastened together using screws and screw bosses 136, or, alternatively, other fasteners. These fasteners preferably are located in a variety of locations and are not limited by those shown in FIG. 5 or other figures.

The compact abdominal exercise apparatus 100 includes slot 138. In the preferred embodiment, slot 138 is formed in the center of the back first member 158. Slot 138 allows the first member 112 to slide between the first elastic anchor member 126 that is fastened to the second member 114 by elastic anchor member fasteners 140. Preferably, the length of slot 138 is between 1 inch and 16 inches, and most preferably 6 inches. Preferably, the width of slot 138 is between 0.1 inches and 2.0 inches, and most preferably 0.25 inches.

The elastic anchor member fasteners 140 preferably are bolts or other fasteners. In the preferred embodiment, the elastic anchor member fasteners 140 preferably are of a width less than slot 138, to enable the second member 114 to attach to the first elastic anchor member 126. The vent holes 142 allow pressure equalization within the housing of the compact abdominal exercise apparatus 100. In the preferred embodiment, the vent holes 142 are located preferably near the second member proximal end 122, and can be located elsewhere to facilitate pressure equalization.

In the preferred embodiment of the present invention, the first member 112 slides within the second member 114, via second member outer channels 144 and second member inner channels 150. In the preferred embodiment, the first member 112 is attached to the upper body support 104 and the second member 114 is attached to the lower body support 102. As described above and as would be known to those skilled in the art, this configuration could be swapped, whereby the first member 112 is attached to the lower body support 102 and the second member 114 is attached to the upper body support 104.

The second member outer channels 144 and second member inner channels 150 define the second member channels 135, as shown in FIG. 5. The first member channels 137 slide within the second member channels 135. The second elastic anchor member mounts 148 accept the elastic anchor member fasteners 140.

The slotted protective access cover 466 includes a quick access opening 468 that allows a user to access and quickly connect or disconnect the elastic members 430, 432, and 460, thereby increasing or decreasing the resistive force of the compact abdominal exercise apparatus 400. In this embodiment, the elastic members 430, 432, and 460 preferably are connected or disconnected from either the first elastic anchor member 426 or the second elastic anchor member 428 without opening a cover, while also providing protection for the user from the internal connector assembly 110. In the embodiment 400 depicted in FIG. 16, the upper rear protective cover 470 and upper front protective cover 472 also protect the user from the internal connector assembly 110. The upper rear protective cover 470 and upper front protective cover 472 are attached together by fasteners as described above or, preferably, they snap around the first member 412. The lower front protective cover 474 and lower back protective cover 475 preferably attach to each other by fasteners as described above or, preferably, they snap around the second member 414. Preferably, covers 470, 472, 474, and 475 are made of plastic or, alternatively, some other lightweight material.

In the preferred embodiment, the protective cover 116 includes the protective cover hinge tabs 176 that slide into the front second member holes 188, thereby creating a hingeable cover for opening to access the connector assembly 110 and the elastic members 130, 132, and 160. The protective cover hinge tabs 176 protrude slightly from the sides of the protective cover 116 to fit into the front second member holes 188. Other methods of opening and closing the protective cover 116 such as clips and snaps, or other methods commonly known to those skilled in the art, can be employed.

The second elastic anchor member 128 includes a second elastic anchor member upper catch 182 that is sized smaller than the elastic member end 178 of the elastic members 130, 132, and 160. The second elastic anchor member opening 180 is sized slightly larger in diameter than the elastic member body 190 of the elastic members 130, 132, and 160. The second elastic anchor member indent 184 fits the first member ridge 139, and the second elastic anchor member curved portion 183 fits the first member channels 137.

The first member 112 includes a first member ridge 139 at the junction of the first member channels 137. In FIG. 5, one first member ridge 139 is depicted; however, the compact abdominal exercise apparatus 100 preferably includes one, two, or more first member ridges 139. The first member channels 137 have a slightly smaller diameter than the second member channels 135, to allow for the first member 112 to slideably move within the second member 114.

The compact abdominal exercise apparatus 100, 400, and 500 can be used in a seated position, as in FIGS. 18A and 18B, or in a supine position with legs bent, as in FIG. 19. In the seated position, as depicted in FIGS. 18A and 18B, the user rests the lower body support 102, 402, and 502 on the top of the legs in the lap area, grasps the handles 108, 408, and 508, and then crunches downward applying pressure on the handles 108, 408, and 508 such that the first member 112, 412, and 512 slides down within the connector assembly 110 causing the first elastic members 130, 132, and 160 to stretch and provide a resistive force against the downward crunching movement.

In the preferred embodiment, the compact abdominal exercise apparatus requires the user to crunch relatively straight downward in order for the first member 112, 412, and 512 to slide within the connector assembly as shown in FIGS. 18A and 18B. This relatively straight downward crunching motion requires flexion of the user's lower vertebra column, thereby isolating the abdominal muscles, as opposed to an incorrect crunch involving bending the body forward at the hips which recruits the hip flexors (seated or supine positions) and/or lower back muscles (seated position). The upper body support 104, 404, and 504 is designed to provide for maximum sliding motion between the first member 112, 412, and 512 and the second member 114, 414, and 514, while maintaining a compact design that rests comfortably on the user's lap and the handles 108, 408, and 508 are approximately at chest height.

The aforementioned crunching motion provides resistive training of all of the abdominal muscles, including the upper and lower rectus abdominus, the internal and external abdominal obliques and the transverse abdominus. In the preferred embodiment, the invention provides for one or more resistance levels such that the user can add additional elastic members 130, 132, and 160 for higher resistance as their firmness level increases. Further, the beginner resistance level is approximately 10 pounds resistive force and progresses up to more than 50 pounds of resistive force for advance settings using additional elastic members 130, 132, and 160.

The compact abdominal exercise apparatus 100, 400, and 500 alternatively can be used in the supine position, as depicted in FIG. 19. In the supine position, the user lies flat on his/her back with legs bent with feet either flat on the floor or with feet against a wall or other stable surface. The crunching movement is similar to that described for the seated crunch; however, in the supine position, the user must also overcome the gravitational resistance of the user's upper body in addition to the resistive force of the compact abdominal exercise apparatus 100, 400, and 500 during the crunching motion. The resistive force provided by the present invention therefore enhances the supine crunch providing abdominal training beyond what is achievable from a standard supine crunch without the compact abdominal exercise apparatus.

The compact abdominal exercise apparatus 100, 400, and 500 alternatively can be used to do leg-ups in the supine position. In the supine position, the user lies flat on his/her back with legs bent with feet in the raised-position. The user then pulls their legs towards the body (versus a standard crunch where the user pulls their head and upper torso up and in towards the legs). The resistive force provided by the present invention therefore enhances the supine crunch providing abdominal training beyond what is achievable from a standard supine crunch without the compact abdominal exercise apparatus.

Further, the compact abdominal exercise apparatus 100, 400, and 500 alternatively can be used to perform oblique exercises, where the user rests the lower body support 102, 402, and 502 on the top of one thigh, and then crunches downward slightly towards that thigh, such that the oblique abdominals are independently exercised. The starting position puts the user's torso in a slightly angled position or gives them a slight twist, which then emphasizes the oblique abdominals further. To exercise the other side, the user merely shifts the unit over to the other thigh. This can be performed in either a seated position or in the supine position.

There has been described a compact abdominal exercise apparatus that has a quick change resistive force with a plurality of elastic members and a slotted connector assembly that is more effective, efficient, and ergonomic than prior art compact abdominal exercise apparatuses. It should be understood that the particular embodiments shown in the drawings and described within this specification are for purposes of example and should not be construed to limit the invention, which will be described in the claims below. Further, it is evident that those skilled in the art may now make numerous uses and modifications of the specific embodiments described, without departing from the inventive concepts. Consequently, the invention is to be construed as embracing each and every novel feature and novel combination of features present in and/or possessed by the invention herein described.

What is claimed is:

1. A compact abdominal exercise apparatus comprising:

(a) a lower body support adapted to engage a portion of the human body below the abdomen;

(b) an upper body support adapted to engage a portion of the human body above the abdomen; and (c) an upper body support and lower body support connector assembly comprising:

a first member having a first member proximal end and a first member distal end;

a second member having a second member proximal end and a second member distal end;

a first elastic anchor member attached to said first member;

a second elastic anchor member attached to said second member;

said lower body support attached to the proximal end of one of said first member and said second member and said upper body support attached to the proximal end of the other of said first member and said second member; and said first member slideably fitting within said second member with said first elastic anchor member longitudinally slideable within said first member and located farther from the one of said lower body support and said upper body support to which it is attached than the one of said lower body support and said upper body support to which it is not attached.

2. A compact abdominal exercise apparatus as in claim 1 and further including a first elastic member connected between said first elastic anchor member and said second elastic anchor member.

3. A compact abdominal exercise apparatus as in claim 2 wherein said first elastic member comprises an elastic cord.

4. A compact abdominal exercise apparatus as in claim 2 wherein said first elastic member comprises an elastic band.

5. A compact abdominal exercise apparatus as in claim 2 and further including a second elastic member connectable between said first elastic anchor member and said second elastic anchor member.

6. A compact abdominal exercise apparatus as in claim 5 wherein said elastic members comprise elastic cords.

7. A compact abdominal exercise apparatus as in claim 1 and further including a protective cover substantially enclosing said connector assembly.

8. A compact abdominal exercise apparatus as in claim 7 and further including an elastic member connectable between said first elastic anchor member and said second elastic anchor member, and wherein said protective cover includes an opening providing access to said elastic member.

9. A compact abdominal exercise apparatus as in claim 7 wherein said protective cover assembly is padded.

10. A compact abdominal exercise apparatus as in claim 1 wherein said lower body support is adapted to engage the front portion of the human thigh.

11. A compact abdominal exercise apparatus as in claim 1 wherein said upper body support is adapted to engage a human hand.

12. A compact abdominal exercise apparatus comprising:

(a) a forward thigh member adapted to engage the forward portion of the human thigh;

b) an upper body member adapted to engage a portion of the body above the abdomen;

(c) a plurality of resilient cords;

(d) a lower body cord anchor;

(e) an upper body cord anchor;

(f) a constraint assembly connecting said lower body member and said upper body member; said constraint assembly permitting relative motion of said lower body member and said upper body member in a first direction along a line connecting said lower body member and said upper body member and preventing relative motion of said lower body member and said upper body member in directions perpendicular to said first direction; said constraint assembly including: a lower body support member rigidly connecting said lower body member and said lower body cord anchor; and an upper body support member rigidly connecting said upper body member and said upper body cord anchor;

(g) said lower body cord anchor located closer to said upper body member than said upper body cord anchor; and (h) said resilient cords connectable between said lower body cord anchor and said upper body cord anchor.

13. A compact abdominal exercise apparatus as in claim 12 and further including a protective cover substantially enclosing said constraint assembly and said cord anchors, said protective cover including an opening for accessing said cords.

14. A compact abdominal exercise apparatus comprising:

(a) a lower body member adapted to engage a portion of the human body below the abdomen;

(b) an upper body member adapted to engage a portion of the human body above the abdomen;

(c) a constraint assembly connecting said lower body member and said upper body member, said constraint assembly permitting relative motion of said lower body member and said upper body member in a first direction along a line connecting said lower body member and said upper body member and preventing relative motion of said lower body member and said upper body member in directions perpendicular to said first direction, said constraint assembly including a resistance mechanism resisting but not preventing relative motion of said lower body member and said upper body member in said first direction; and (d) a protective cover substantially enclosing said constraint assembly.

15. A compact abdominal exercise apparatus as in claim 14 wherein said constraint assembly includes a resistance adjuster and said cover includes an opening providing access to said resistance adjuster.

16. A compact abdominal exercise apparatus as in claim 14 wherein said cover comprises a first piece and a second piece and a fastener for fastening said first piece to said second piece.

17. A compact abdominal exercise apparatus as in claim 14 wherein said cover comprises molded plastic.

18. A method for exercising abdominal muscles wherein a user grasps the handles of a compact abdominal exercise apparatus comprising a connector assembly, said connector assembly comprising a first member attached to said handles and slideably fitting within a second member adapted to fit the users lap, said method comprising:

compressing said first member towards said second member and stopping at a first position; and pausing said compressing for a period of time.

19. A method for exercising as in claim 18 and further including:

compressing said first member towards said second member and stopping at a second position;

pausing said compressing for a period of time; and releasing said compressing.

* * * * *

UNITED STATES PATENT AND TRADEMARK OFFICE

CERTIFICATE OF CORRECTION

PATENT NO. : 6,712,742 B2
DATED : March 30, 2004
INVENTOR(S) : William G. Suiter It is certified that error appears in the above-identified patent and that said Letters Patent is hereby corrected as shown below:

Column 15,
Line 49, delete "gitudinally slideable within said first member and" and insert
-- gitudinally slideable with said second member and --

Signed and Sealed this

Twenty-eighth Day of December, 2004

JON W. DUDAS
*Director of the United States Patent and Trademark Office*

UNITED STATES PATENT AND TRADEMARK OFFICE

CERTIFICATE OF CORRECTION

PATENT NO. : 6,712,742 B2
DATED : March 30, 2004
INVENTOR(S) : William G. Suiter It is certified that error appears in the above-identified patent and that said Letters Patent is hereby corrected as shown below:

Column 15,
Line 49, delete "gitudinally slideable within said first member and" and insert
-- gitudinally slideable within said second member and --

This certificate supersedes Certificate of Correction issued December 28, 2004.

Signed and Sealed this

Third Day of May, 2005

JON W. DUDAS
*Director of the United States Patent and Trademark Office*

Disclaimer

6,712,742 B2—William G. Suiter, Campbell, CA. COMPACT ABDOMINAL EXERCISE APPARATUS. Patented March 30, 2004. Disclaimer filed April 29, 2005, by the inventor, William G. Suiter.

Hereby enters this disclaimer to claim 12 of said patent.

(*Official Gazette, November 1, 2005*)